US007404534B1

(12) United States Patent
Hajianpour

(10) Patent No.: US 7,404,534 B1
(45) Date of Patent: Jul. 29, 2008

(54) APPARATUS FOR ATTACHING A BOTTLE TO A SUPPORT STRUCTURE

(75) Inventor: Zoya Hajianpour, Fort Lauderdale, FL (US)

(73) Assignee: Zoya, Inc., Ft. Lauderdale, FL (US)

( * ) Notice: Subject to any disclaimer, the term of this patent is extended or adjusted under 35 U.S.C. 154(b) by 379 days.

(21) Appl. No.: 10/847,767

(22) Filed: May 18, 2004

(51) Int. Cl.
*A45F 5/00* (2006.01)

(52) U.S. Cl. ..... 248/230.1; 248/248; 248/313; 224/419

(58) Field of Classification Search ..... 248/229.2, 248/69, 61, 230.8, 74.3; 224/419, 420, 425, 224/445, 446; 24/16 PB, 16 R, 30.5
See application file for complete search history.

(56) References Cited

U.S. PATENT DOCUMENTS 3,632,069 A 1/1972 Thayer et al.
3,807,679 A 4/1974 Burke et al.
3,965,538 A * 6/1976 Caveney et al. ..... 24/16 PB
4,092,765 A * 6/1978 Joyce ..... 24/16 PB
4,570,835 A 2/1986 Criqui et al.
4,767,092 A 8/1988 Weatherly
4,955,572 A 9/1990 Simmons
4,993,611 A 2/1991 Longo
5,060,832 A 10/1991 Link
5,105,958 A 4/1992 Patton
5,199,678 A 4/1993 Luebke
5,244,135 A 9/1993 Nelson
D340,583 S 10/1993 Kahn
5,249,770 A 10/1993 Louthan
5,263,618 A 11/1993 Tlalvera
5,299,720 A 4/1994 Koch, III
5,325,991 A 7/1994 Williams
5,331,721 A 7/1994 Raum, Sr.
5,381,922 A 1/1995 Gladman et al.
5,400,990 A 3/1995 Frankel
5,409,151 A 4/1995 Freimark
5,425,484 A 6/1995 Kawand et al.
5,517,727 A * 5/1996 Bernard et al. ..... 24/16 PB
5,577,647 A 11/1996 Pittarelli et al.
5,597,087 A 1/1997 Vinarsky
5,695,101 A 12/1997 Frietze
5,695,162 A 12/1997 DiCastro
5,711,424 A 1/1998 Kiesow
5,711,465 A 1/1998 Pittarelli et al.
5,732,860 A 3/1998 Faraj
5,743,620 A 4/1998 Rojas et al.
5,833,188 A 11/1998 Studdiford et al.
5,966,865 A 10/1999 Jones
5,984,145 A 11/1999 McAllister
5,988,464 A 11/1999 Butler et al.
6,004,033 A 12/1999 Cirone
6,019,335 A 2/2000 Schati (Continued)

*Primary Examiner*—Korie H. Chan
*Assistant Examiner*—Steven M. Marsh
(74) *Attorney, Agent, or Firm*—Ronald V. Davidge

(57) ABSTRACT

A bottle holder includes a first flexible strap that is clamped around a bottle, with an end of the strap being clamped by pivoting a locking lever in a locking block. A first version of the bottle holder has a clip for attachment to the belt or waistband of the user's clothing. A second version has a second belt for attachment to a stationary member, such as the rail of an exercise machine.

6 Claims, 3 Drawing Sheets

U.S. PATENT DOCUMENTS

| | | | | |
|---|---|---|---|---|
| 6,081,695 | A | 6/2000 | Wallace et al. | |
| 6,095,386 | A | 8/2000 | Kuo | |
| 6,131,779 | A | 10/2000 | Gendala | |
| 6,149,109 | A * | 11/2000 | Stankowski | 248/74.3 |
| 6,161,885 | A | 12/2000 | Walker | |
| 6,168,057 | B1 | 1/2001 | Schwabe | |
| 6,279,203 | B1 * | 8/2001 | Hundley et al. | 24/16 PB |
| 6,279,794 | B1 | 8/2001 | Mayazaki | |
| 6,364,184 | B1 | 4/2002 | Hauck et al. | |
| 6,394,329 | B1 | 5/2002 | Magee | |
| 6,401,993 | B1 | 6/2002 | Andrino | |
| 6,631,876 | B1 | 10/2003 | Phillips | |
| 6,658,703 | B1 * | 12/2003 | Teagno et al. | 24/16 PB |
| D487,660 | S | 3/2004 | Sayers et al. | |
| 6,807,714 | B2 * | 10/2004 | O'Young et al. | 24/16 PB |
| 7,017,237 | B2 * | 3/2006 | Magno et al. | 24/16 PB |

* cited by examiner

APPARATUS FOR ATTACHING A BOTTLE TO A SUPPORT STRUCTURE

CROSS REFERENCE TO RELATED APPLICATIONS

This application is related to U.S. patent application Ser. No. 10/336,467, filed Jan. 3, 2003, entitled "Article Holder with Attachment Clip," and additionally to U.S. patent application Ser. No. 10/634,491, filed Aug. 5, 2003, entitled "Clip for Attaching a Cylindrical Object to a Belt or Waistband."

BACKGROUND OF THE INVENTION

1. Field of the Invention

This invention relates to apparatus for attaching a generally cylindrical object, such as a bottle, to a support structure, and, more particularly to attaching such an object a belt or waistband or to a fixed support structure, such as a rail of an exercise machine.

2. Summary of the Background Art

Many people prefer to drink certain types of bottled water or other drinks to an extend sufficient to justify carrying a personal supply of such liquids with them. While such liquids are readily available in grocery and convenience stores in small bottles suitable for individual consumption, a particular problem arises during walking, jogging, or while performing other moving exercises in that it is inconvenient to a bottle of liquid in one's hand. While such exercises tend to stimulate thirst, they also often carry the individual into locations where bottles of the desired liquids are not available. Thus, what is needed is a convenient method for attaching such a bottle to one's clothing so that it can be carried while the hands are left free.

Many individuals regularly use exercise equipment, such as treadmills and stationary bicycles for extended workouts or for workouts of shorter duration but faster pace. In either case, the person using the equipment often becomes thirsty before the workout period is completed. It is often desirable, both for reasons of personal comfort and for reasons of physical health to replace fluids lost during exercise before the period of using a particular piece of exercise equipment is completed. Yet, it is inconvenient and often undesirable to leave the exercise equipment to obtain water or another drink tailored to replace lost fluids; to interrupt an exercise program may jeopardize its effectiveness. Thus, what is needed is a method for providing water or another fluid to be drunk while using the exercise equipment. Since many types of exercise equipment include handrails or other horizontal bar structures within reach of a person using the equipment, this need can be filled by providing a means to removable attachment of a bottle to such a horizontal structure.

Several patents describe a bottle holder including an aperture engaging the neck of a water bottle and a lower portion extending downward to be held inside the user's belt. For example, U.S. Pat. No. 6,131,779 describes a bottle carrier having a connection section formed as an inverted U-shaped clip that is connected by a rod to a gripping section having a pair of claws with curved ends, between which the neck of a bottle is received. U.S. Pat. No. 6,394,329 describes a holder for attaching a bottle to a user's belt, with the holder including an upright portion to be inserted behind the belt and a lateral portion including two connected openings of different sizes to permit the insertion and removal of the bottle neck. U.S. Pat. No. 6,019,335 describes a bottle holder having a horizontal upper portion, an inclined intermediate portion, and a vertical lower portion that can be molded in one piece from plastic.

The intermediate and upper portions are configured with an oval slot that is configured to accept and hold the neck of a bottle, with the bottle being supported by a ring around the neck of the bottle. The lower portion is configured as an inverted U-shaped clip, including a slot through which a VELCRO® type strap extends to encircle the bottle. What is needed is a bottle holder having a flexible strap with ends connected by a clamping mechanism providing belt tension to hold the bottle without a need to engage the neck of a bottle. Such a bottle holder would be usable with a number of bottle configurations, without regard for particular features of the bottle neck.

U.S. Pat. Nos. 5,331,721 and 6,168,057 each describe a U-shaped clip that can be applied to an object to facilitate holding the object by means of the clip on one's belt, waistband, or on another supporting edge of ones clothing, such as a pocket. Each of these clips has an inner leg to extend downward inside the belt or clothing and an outer leg, also extending downward from the top of the clip, with an outer surface having means for attachment to the object to be held. In the device of U.S. Pat. No. 5,331,721, the outer surface of the outer leg has a rectangular adhesive pad and a removable protective liner, so that the object to be held is securely clip. In the device of U.S. Pat. No. 6,168,057, the outer surface of the outer leg has the first strip of a pair of removably attachable fastening strips. The second strip is provided with an adhesive backing and a release layer, so that the object to be held is releasably attached to the clip. In the device of each of these patents, the outer surface of the outer leg is flat, so that the clip can only be attached to an object having a flat side, such as a walkie-talkie, a cordless telephone, or a single-use camera. What is needed is a belt clip having an adjustable strap to fasten around a generally cylindrical object, such as a water bottle.

Other patents show belt clips provided as portions of structures configured for special purposes. For example, U.S. Pat. No. 6,364,184 shows an adapter for removably holding a cellular phone on a belt clip to be secured by a belt. U.S. Pat. No. 5,711,424 shows a belt clip for a single-use camera, with the belt clip being included within the display packaging of the camera. U.S. Pat. No. 6,081,695 shows a holster having a loop for receiving the end of the user's belt and a main body portion with a pair of spaced-apart openings for receiving a belt clip forming part of a pager or cellular phone. U.S. Pat. No. 5,381,922 describes a carrier for a cylindrical article comprising a clip attachable to the user's belt and a flexible cup-like holder capable of closely fitting around the article, and adhesive pads on the clip and holder for attaching the holder to the clip. Again, what is needed is a belt clip having an adjustable strap to fasten around a generally cylindrical object, such as a water bottle.

U.S. Pat. No. 4,955,572 describes a supporting device for sports bottles having a liquid container with an integral neck and a cap that fits on the neck to hold the sports bottle in a vertical position. The supporting device is an integrally formed manufacture having a retaining section with a hole to fit over the neck of the container and is secured against vertical movement when the sports bottle cap is screwed down. Integral with the supporting device is a mounting tab which extends downward toward the container's base at or near the side of the sports bottle container when the supporting device is secured on the sports bottle. The bottle can now be hung by placing the mounting tab over one's belt to free his hands while he is walking. Additionally, by adhering a receiving block, having a hole that accepts the mounting tab, in a convenient location within a car a sports bottle can be hung within a car within easy reach of the user. This device relies on the wide mouth of the bottle to hold the supporting device in place on the bottle and on the use of a straw to drink from the bottle, eliminating a need to unscrew the cap, which would loosen the attachment of the supporting device to the bottle. Thus, what is needed is a bottle supporting device that can be used with many types of bottles, including the small bottles, without wide necks, in which spring water is often sold.

Other patents describe specialized containers into which a fluid is poured before it is consumed. For example, U.S. Pat. No. 5,988,464 describes a wide-mouth drink bottle having one strip of a two-part fastener extending along one side of the bottle. The mating part of the two-part fastener extends along the side of a vertical strap having a pair of loops through which the user's belt is placed. U.S. Pat. No. 5,984,145 describes a body-mounted water dispensing system for providing a convenient method of drinking liquids while exercising. The system includes a water container and pump, mounted on a belt, together with an outlet hose and drinking tube extending upward to the wearer's mouth. Again, what is needed is a low-cost disposable system. U.S. Pat. Nos. 5,743,620, 6,260,731, and 6,279,794 each describe a specialized bottle including a clip allowing the bottle to be attached to clothing. What is needed is a system allowing the use of readily available disposable bottles, without requiring the fluid to be poured into another container before it is consumed, and similarly eliminating a need to wash the container after use.

The use of a belt to hold an elongated group of objects to a bracket is described in U.S. Pat. No. 3,632,069, in the form of a bracket for mounting wire bundles or the like to be held by binder ties and for retaining the binder ties adjacent flanged lightening holes and bulkheads. The bracket further includes a single mounting leg. What is needed is a belt configured to allow loosening and subsequent tightening without tools for the application of releasably holding water bottles.

U.S. Pat. No. 5,409,151 describes a shoulder strap and a neck strap forming part of a hands-free canteen for carrying a drinkable liquid, such as mineral water. The assembly additionally includes a standard liquid containing bottle whose externally threaded neck is engaged by a screw-on cap having a small loop integral therewith. Another form of neck strap is described in U.S. Pat. No. 5,244,135, with the neck strap passing through a slot in a flange of a container being carried, and with the neck strap comprising a flexible cord having ends held together with an aglet through a friction fit. Another support for a beverage container that may be placed around the neck of the user is described in U.S. Pat. No. 4,993,611. What is needed is a method for hooking a water bottle to a belt or waistband without requiring modification to the bottle, such as a cap with an integral loop or a slot provided for passage of a strap.

U.S. Pat. Nos. 5,577,647 and 5,711,465 each describe a bottle carrying device that replaces the cap of a conventional water bottle. The bottle carrying device includes a carrying strap and a spout through which the water can be consumed when the bottle is squeezed. What is needed is a strap that can be attached to a bottle without a requirement to remove and replace the cap.

Other patents, including U.S. Design Pat. Nos. D340,583 and D487,660 and U.S. Pat. Nos. 3,807,679, 6,161,885, and 6,401,993 describe bottle carriers in which bottles, including the large water bottles used in water coolers, are carried from handles or straps. What is needed is a carrier for carrying small, conventional water bottles attached to the user's belt or waistband.

Other patents described significantly more complex structures for carrying one or more water bottles and other articles. For example, U.S. Pat. No. 5,263,618 describes a shoulder harness having a water bottle cover serving as a holder, which is attached to the harness strap by a VELCRO® closure. U.S. Pat. No. 5,732,860 describes a sports utility belt including a central body adapted to receive one or more water bottles connected to a drinking tube. U.S. Pat. No. 5,695,101 describes apparatus including a number of adjustable straps for carrying sports equipment such as a folding chair, a body board, and a beverage holder. Again, what is needed is a method for hooking a water bottle to a belt or waistband.

U.S. Pat. No. 5,299,720 describes a combined handle and friction connector for a container, in which a handle assembly can be either integral with a container or attachable thereto. The handle is spaced from the container by an opening for receiving the hand of the user, and has a snap-on groove for detachably connecting the handle and the associated container to a tubular support having a range of varying diameters. What is needed is a clamp having an adjustable strap for supporting attachment to supports having a wider range of shapes and dimensions.

The patent art describes a number of devices for removably attaching water bottles to structural elements by means of loop and hook closure mechanisms, such as VELCRO® closures. For example, U.S. Pat. No. 6,004,033 describes a composite water bottle holder formed by sewing a first edge of a sheet of neoprene material to form a generally cylindrical shaped water straps of bottle holder with a VELCRO® attachment mechanism including mating straps of material. U.S. Pat. No. 5,249,770 describes a holder including a body with a slot through which a flexible strap extends. One side of the strap forms one side of the VELCRO® closure, while the other side of the closure is formed by one or more pads attached to the body. One end of the strap is pulled around the structural element and through a buckle at the opposite end of the strap to be fastened to the pad(s) attached to the body. U.S. Pat. No. 5,199,678 describes a holder of holding a cup on the arm of a chair. The holder includes an "L"-shaped support structure having an upper surface along which one side of the VELCRO® closure extends and a lower surface from which a strap forming the other side of the closure hangs. The support structure is placed atop the chair arm, with the strap extending around the chair arm and along the upper surface of the support structure. U.S. Pat. No. 5,833,188 describes a fabric strap for releasably securing a bicycle accessory to a bicycle, with the fabric strap including the loop and hook portions associated with VELCRO® closures. U.S. Pat. Nos. 5,325,991 and 5,381,932 each describe a holder including a hollow cylinder, open at the top, for holding a cylindrical object, such as a bottle, cup, or can, and additionally including an attachment member having an inner leg that can extend downward inside a belt or waistband and an outer leg removably attached to the hollow cylinder by a two-part fastener, such as a VELCRO fastener. What is needed is a low-cost clip that can be attached to a disposable bottle and disposed with the bottle, eliminating a need to return with a large empty holder. What is needed is a lower cost means for removably attaching a bottle holder to a structural element without requiring the use of such closures.

A number of patents, of which U.S. Pat. Nos. 5,060,832 and 5,425,484 are exemplary, describe methods for attaching a water bottle to a bicycle so that, while the water bottle is easily removable, a part of the attachment mechanism remains attached to the bicycle, for example, being bolted thereto. Since the bicycle typically belongs to the individual installing and using the water bottle and repeatedly using the bicycle, this remaining attachment portion does not present a serious problem. U.S. Pat. No. 5,105,958 describes a similar method for removably attaching a water bottle to a golf bag. However, what is needed is a water bottle attachment mechanism that is easily and totally removed from exercise equipment in a gymnasium, so that the equipment can be used by others, and so that the water bottle can be used on other equipment.

U.S. Pat. No. 5,597,087 describes a sports bottle having a hook for suspending the bottle from a support structure. Since sports bottles having a number of desirable features without such a hook are widely available filled with suitable liquids, what is needed is a mechanism for removably attaching an existing water bottle to a support structure. Additionally, since the support surface provided by exercise equipment may move with its use, causing a water bottle simply suspended from a hook to swing, what is needed is a mechanism clamping the water bottle to the support structure.

Other patents, including U.S. Pat. Nos. 4,570,835, 4,767,092, 5,400,990, 5,695,162, 5,966,865, and 6,631,876, describe relatively large holders for clamping bottles and other cylindrical devices to stationary structures. What is needed is a device including only an attachment adapter and a pair of flexible belt assemblies, that can be easily carried with a water bottle to a gymnasium and that will not present a significant burden when returning from the gymnasium, after disposal of the empty water bottle.

SUMMARY OF THE INVENTION

It is an objective of the invention to provide a means for attaching a bottle to a support structure to free the users hands, with the support structure being a stationary element, such as a rail of an exercise machine, or a portion of the clothing of the user.

It is another objective of the invention to provide a low cost and effective means for adjusting the length of a strap used for attachment to a bottle or to a stationary element.

According to one aspect of the invention, apparatus for attaching a bottle to a support structure is provided, with the apparatus including a first flexible strap and an attachment structure. The first flexible strap includes a locking block at one end of the first flexible strap. The locking block has a strap receiving surface for removably receiving a second end of the first flexible strap, opposite the first end, with the first flexible strap formed into a loop around the bottle. The locking block additionally has a locking lever, mounted to move between a disengaged position, allowing the second end of the first flexible strap to slide freely along the strap receiving surface, and an engaged position, in which the second end of the first flexible strap is held in place against the strap receiving surface. The attachment structure has a strap receiving surface for receiving and holding the first flexible strap and support attachment means for engaging the support structure. For example, the support structure may be an edge of the clothing of a user wishing to carry the bottle with his hands being free, or a rail of an exercise machine on which the bottle is temporarily held.

In one embodiment of the invention, the attachment structure includes a first downward-extending leg having the strap receiving surface, a second downward-extending leg, and a connecting portion extending between the first and second downward-extending legs. The support attachment means includes an edge receiving slot extending in a first direction from an open lower end between the first and second downward-extending legs for receiving an edge portion of the support structure.

In another embodiment of the invention, the support attachment means includes a second flexible strap including a locking block at one end of the second flexible strap. The locking block has a strap receiving surface for removably receiving a second end of the second flexible strap, opposite the first end, with the second flexible strap formed into a loop around the bottle. The locking block additionally has a locking lever, mounted to move between a disengaged position, allowing the second end of the second flexible strap to slide freely along the strap receiving surface, and an engaged position, in which the second end of the second flexible strap is held in place against the strap receiving surface. The attachment structure has a strap receiving surface for receiving and holding the second flexible strap and support attachment means for engaging the support structure.

DETAILED DESCRIPTION OF THE INVENTION

Figure 1:
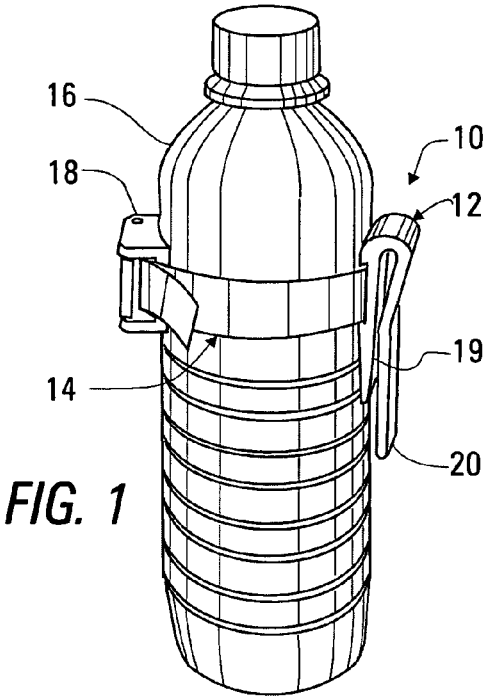
FIG. 1 is a perspective view of a bottle holder built in accordance with a first embodiment of the invention.

FIG. 1 is a perspective view of a bottle holder 10 built in accordance with a first version of the invention, including an attachment block 12 and a flexible strap 14, which is held together extending around a bottle 16 by means of a locking block 18. The attachment block 12 is formed as an inverted "U"-shaped structure, having a first downward extending leg 19, through which a central portion of the flexible strap 14 is attached and a second downward extending leg 20 for placement inside the belt or waistband of the user's clothing, so that the bottle holder 10 can be used to removably attach the bottle 16 to the user's clothing.

Figure 4:
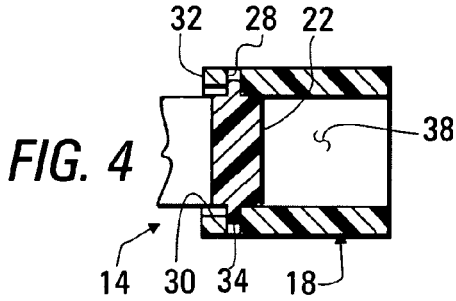
FIG. 4 is a fragmentary cross-sectional plan view of the strap of FIG. 2, taken as indicated by section lines 4-4 in FIG. 3.
Figure 5:
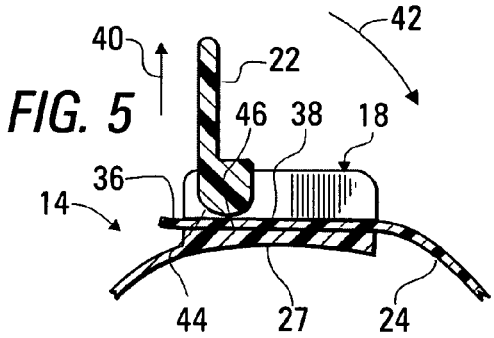
FIG. 5 is a fragmentary cross-sectional elevation of the strap of FIG. 2, taken as indicated by section lines 5-5 therein and shown as looped with a locking lever shown in an disengaged position.
Figure 6:
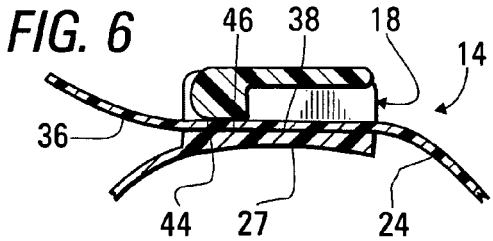
FIG. 6 is a fragmentary cross-sectional elevation similar to FIG. 5, except that the locking lever is shown in an engaged position.
Figure 2:
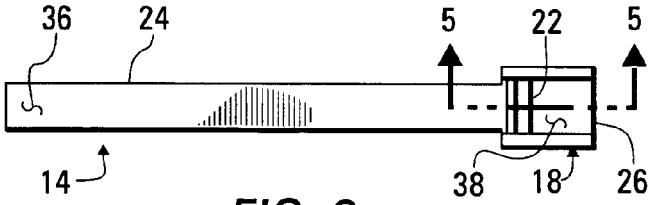
FIG. 2 is a plan view of a strap within the bottle holder of FIG. 1, shown as extended.

Various aspects of the strap 14 will now be discussed with references being made to FIGS. 2-6. FIGS. 1 and 2 show the strap 14 in an extended condition, being removed from the bottle 16 and the attachment block 12, with FIG. 1 being a plan view, while FIG. 2 is an elevation. FIG. 4 is a fragmentary cross-sectional plan view of the strap 14, taken as indicated by section lines 4-4 in FIG. 3. FIGS. 5 and 6 are each fragmentary cross-sectional elevations of the strap 14, shown as looped, and taken as indicated by section lines 5-5 in FIG. 2, with FIG. 5 showing a locking lever 22 in an disengaged position, while FIG. 6 shows the locking lever 22 in an engaged position.

Figure 3:
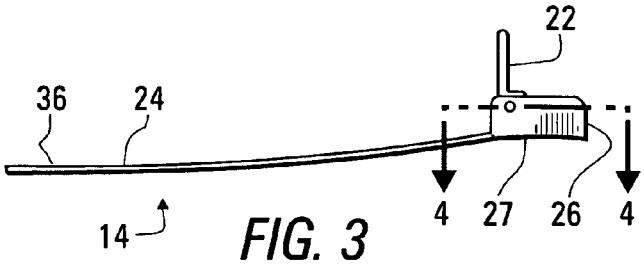
FIG. 3 is an elevation of the strap of FIG. 2.

Referring first to FIGS. 2 and 3, in accordance with a preferred version of the invention, the locking block 18 and an elongated portion 24 of the strap 14 are preferably formed as integral portions of a single part, to which the locking lever 22 is pivotally attached. The locking block 18, which is disposed at a first end 26 of the strap 14, preferably includes a concave inward-facing surface 27.

Referring to FIG. 4, the locking block 18 is provided with a pair of holes 28, in alignment with one another and with a pair of grooves 30 extending inward from edges 32, so that pin portions 34 of the locking lever 22 can be snapped into place within the holes 28, pivotally mounting the lever 22 within the attachment block 12.

When the locking lever 22 is in its disengaged position, as shown in FIG. 5, a second end 36 of the strap 14, can be freely slid along a strap receiving surface 38 of the locking block 18, with the flexible portion 24 of the strap 14 being formed into a loop around the bottle 16. The locking lever is disposed outwardly, in the direction of arrow 40, from the strap receiving surface 38. When the locking lever 22 is pivoted in the direction of arrow 42 into the engaged position shown in FIG. 6, the second end 36 of the strap 14 is clamped between a spiral clamping surface 44 of the locking lever and an outward facing clamping surface 46 the strap receiving surface 38. The shape of the spiral clamping surface 46 provides for a gap between the second end 36 of the strap 14 and the locking lever 22 when the locking lever 22 is in the disengaged position of FIG. 5, while establishing a clamping force between the locking lever 22 and the second end 36 when the locking lever 22 is in the engaged position of FIG. 6. Preferably, the movement of the locking lever 22 in the direction of arrow 30 also applies additional tension to the loop formed in the flexible portion 24 of the strap 24, so that an object, such as the bottle 16, within the loop is held more tightly.

Figure 7:
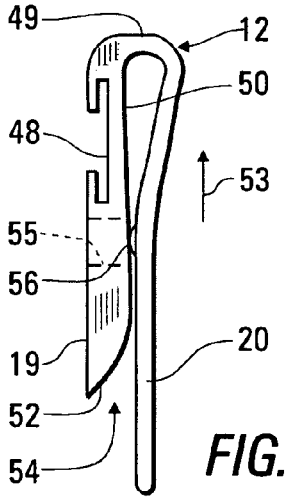
FIG. 7 is a left elevation of an attachment block within the bottle holder of FIG. 1.
Figure 8:
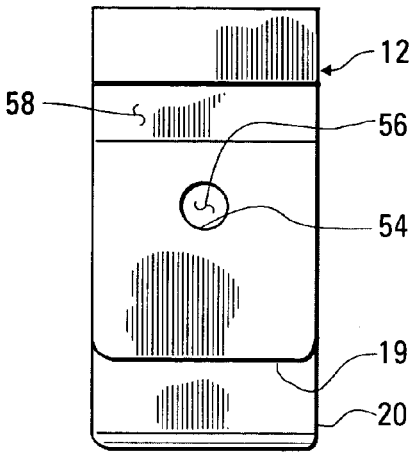
FIG. 8 is a rear elevation of the attachment block of FIG. 7.

Various aspects of the attachment block 12 will now be discussed, with reference being made to FIG. 7, a left elevation thereof, and to FIG. 8, a rear elevation thereof. The attachment block 12 is formed as an inverted "U"-shaped part having a first downward-extending leg 19, including a strap receiving surface 48, and a second downward-extending leg 20 for placement inside the belt or waistband of the user. The upper ends of the downward-extending legs 19, 20 are connected by a connecting portion 49 of the attachment block.

Thus, the attachment block 12 is configured to support the bottle 16 from an edge of a support structure, which may be formed by the belt or waistband of the user's clothing. Such an edge is guided into an edge receiving slot 50 of the attachment block 12 by a curved slot entrance surface 52. The edge receiving slot 50 extends in a first, upward, direction, indicated by arrow 53, from an open lower end 54. The attachment block 12 additionally includes a hole 55 extending from one side of the slot 50 and a bump 56 extending into the hole 54 from the other side of the slot 50, so that a fabric material of the user's clothing will be held in place within the slot 50. The strap receiving surface 48 is formed as a slot extending within the first downward-extending leg 19 in a direction perpendicular to the upward direction of arrow 53. The central part of the flexible portion 24 of the first flexible strap 14 is slid within the strap receiving surface 48 to adjust the location of the locking block 18 relative to the attachment block 12, for user convenience, regardless of variations in the diameter of the bottle 16 being held.

Figure 9:
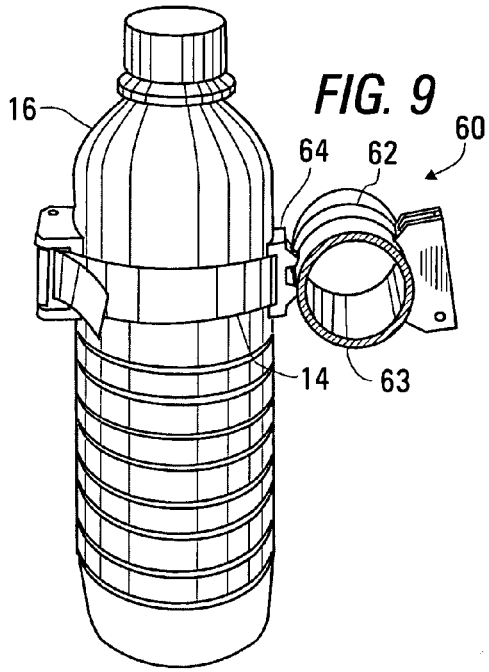
FIG. 9 is a perspective vies of a bottle holder built in accordance with a second embodiment of the invention.
Figure 10:
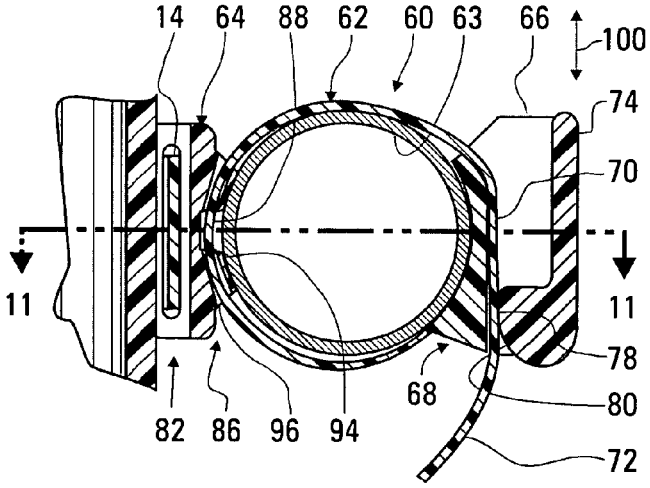
FIG. 10 is a fragmentary cross-sectional elevation of the bottle holder of FIG. 9.
Figure 11:
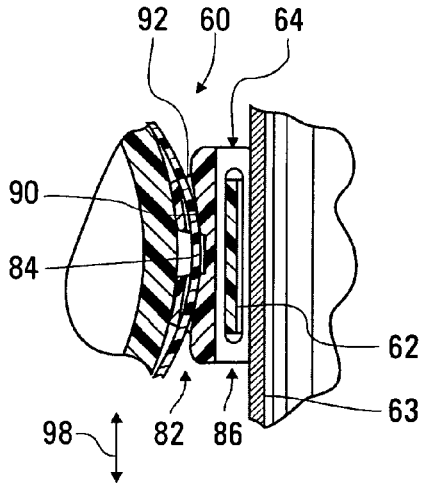
FIG. 11 is a fragmentary cross-sectional plan view of the bottle holder of FIG. 9, taken as indicated by section lines 11-11 in FIG. 10.

A bottle holder 60, built in accordance with a second embodiment of the invention will now be discussed, with reference being made to FIG. 9, a perspective view of the bottle holder 60, FIG. 10, a fragmentary cross-sectional elevation thereof, and FIG. 11, a fragmentary cross-sectional plan view taken as indicated by section lines 11-11 in FIG. 10. The bottle holder 60 includes a first flexible strap 14, for holding a bottle 16, which is similar or identical to the flexible strap forming a part of the bottle holder 10, as described above in reference to FIGS. 1-6, and which is therefore accorded like reference numbers. The bottle holder 60 additionally includes a second flexible strap 62, configured to be formed into a loop fastened around a stationary member 63, such as a rail of an exercise machine, and an adapter block 64 providing a connection between the first flexible strap 14 and the second flexible strap 62.

The second flexible strap 62 includes a number of elements similar to the elements of the first flexible strap 14, as described in detail in reference to FIGS. 2-6. For example, the second flexible strap 62 includes a locking block 66 at its first end 68, and the locking block 66 includes a strap receiving surface 70 for removably receiving a second end 72 of the flexible strap 62 with the second flexible strap 62 formed into a loop around the stationary member 63 forming a support structure. The second flexible strap 62 additionally includes a locking lever 74 pivotally mounted on the locking block 66 to moved between a disengaged position, indicated by dashed lines 76 and the engaged position, in which the locking lever is shown in FIG. 10. When the locking lever 74 is in the disengaged position indicated by dashed lines 76, the second end 72 of the flexible strap 62 slides freely along the strap receiving surface 70. When the locking lever 74 is in the engaged position in which it is shown, the second end 72 of the flexible strap 62 is held against an outwardly facing clamping surface 78 forming a portion of the strap receiving surface 70 by a spiral clamping surface 80 of the locking lever 74.

The attachment block 64 includes a first strap receiving structure 82, holding a central portion 84 of the first flexible strap 14, and a second strap receiving structure 86, holding a central portion 88 of the second flexible strap 62. The first strap receiving structure 82 includes a concave surface 90 formed at a first radius, and a pair of slots 92 extending adjacent the concave surface 90. The second strap receiving structure 86 includes a concave surface 94 formed at a second radius and a pair of slots 96 extending adjacent the concave surface 94. Preferably, the first strap receiving structure 82 is configured so that the first flexible strap 14 extends laterally, in the directions of arrow 98, while the second flexible strap 62 extends vertically, in the directions of arrow 100, perpendicular to the directions of arrow 98.

While the first and second flexible straps 14, 62 are adjustable to accommodate variations in the diameter of the bottle 16 and the support structure 63, in accordance with a preferred version of the invention, the bottle holder 60 is particularly configured to accommodate a bottle 60 having a diameter substantially larger than the diameter of the support structure 63. Thus, the first radius, at which the concave surface 90 of the first strap receiving structure 82 is formed, is substantially larger than the second radius, at which the surface 84 of the second strap receiving structure 86 is formed. Furthermore, the locking block 66 of the second flexible strap 62 preferably includes a concave inward-facing surface 104 having a radius that is substantially smaller than the radius of the concave inward-facing surface 27 of the first flexible strap 14 (shown in FIG. 5).

Alternative features of the flexible straps 14, 62 will now be explained, with reference being made to FIGS. 12-15. While these features are shown as applied to the first flexible strap 14, it is understood that they may be alternately or additionally be applied to the second flexible strap 62, singly or in combination, with the features shown in FIGS. 12-14 being applied to increase the gripping forces applied to and maintained on the bottle 16 and the support structure 63, thereby preventing slipping of the bottle holder 10, 60 relative to the bottle 16 and/or the support structure 63.

Figure 12:
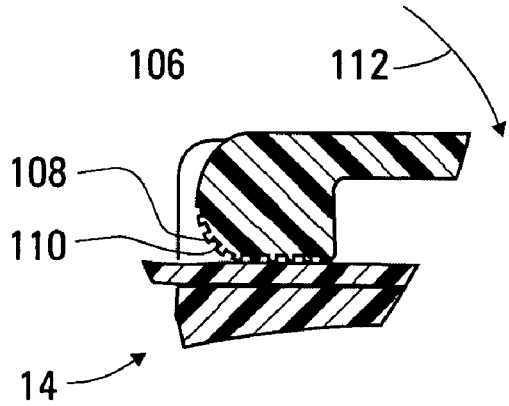
FIG. 12 is a fragmentary cross-sectional elevation of a first alternative version of the strap of FIG. 2, taken as indicated by section lines 5-5 therein.

FIG. 12 is a fragmentary cross-sectional elevation of a first alternative version of the flexible strap 14, taken as indicated by section lines 5-5 in FIG. 2, showing an alternative locking lever 106 having a spiral contact surface 108 with a number of transverse grooves 110, provided to aid in the establishment of tension within the looped portion of the flexible strap 14, so that the forces gripping the bottle 16 are increased, as the alternative locking lever is rotated in the direction of arrow 112 into the position in which it is shown.

Figure 13:
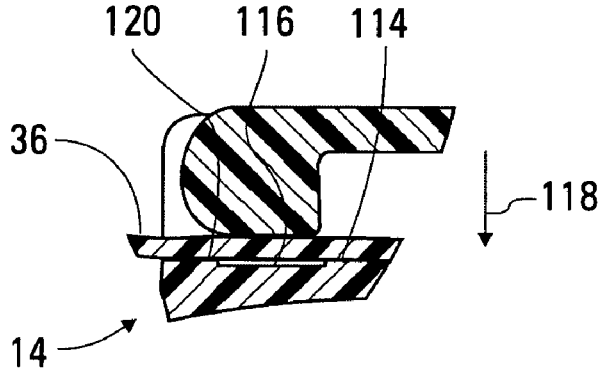
FIG. 13 is a fragmentary cross-sectional elevation of a second alternative version of the strap of FIG. 2, taken as indicated by section lines 5-5 therein.

FIG. 13 is a fragmentary cross-sectional elevation of a second alternative version of the flexible strap 14, also taken as indicated by section lines 5-5 in FIG. 2, showing a strap receiving surface 114 including a recessed surface 116 disposed inwardly, in the direction of arrow 118, from adjacent surfaces of the outwardly facing clamping surface 120. This arrange causes the second end of the strap 14 to be depressed toward the recessed surface 114, being held more tightly along the edges surrounding this surface 114, so that a stronger grip on the bottle 16 is maintained.

Figure 14:
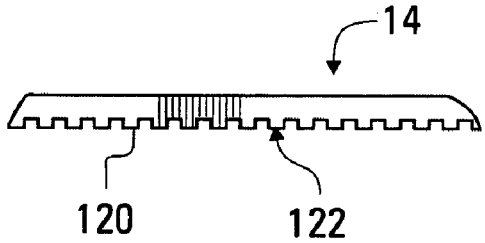
FIG. 14 is a fragmentary elevation of a third alternative version of the strap of FIG. 2.

FIG. 14 is a fragmentary elevation of a third alternative version of the flexible strap 14, showing a number of transverse ridges 120 extending along an inward facing surface 122 to improve the grip maintained on the bottle 16.

Figure 15:
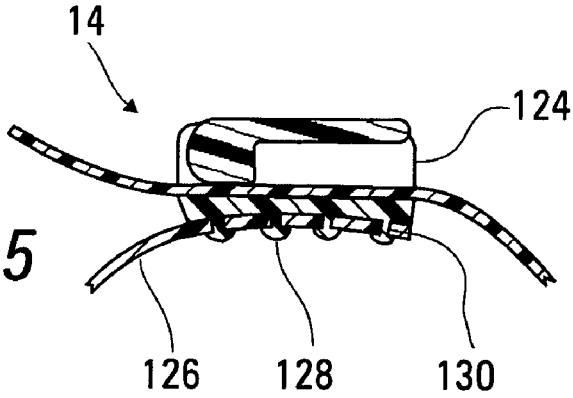
FIG. 15 is a fragmentary cross-sectional elevation of a fourth alternative version of the strap of FIG. 2, taken as indicated by section lines 5-5 therein.

FIG. 15 is a fragmentary cross-sectional elevation of a fourth alternative version of the strap of FIG. 2, again taken as indicated by section lines 5-5 therein, showing a locking block 124 formed separately from a strap portion 126, and attached thereto by heating and forming a number of stud portions 128 of the locking block 124 extending through holes 130 within the strap portion 126.

In the bottle holder 10, built in accordance with the first embodiment of the invention, the flexible strap 14 is the only means attaching the bottle 16 to the attachment block 12. Similarly, in the bottle holder 60, built in accordance with the second embodiment of the invention, the first flexible strap 14 is the only means attaching the bottle 16 to the attachment block 62. In this way, an advantage is provided over bottle holders in the prior art that are provided with structures engaging the neck of the bottle. Since the belt can easily adjusted to accommodate variations in the diameter of the bottle, greater differences in bottle geometry can be accommodated using the bottle holder 10, 60 of the present invention.

Furthermore, in the bottle holder 10, the flexible strap 14 is provided with an inexpensive locking means comprising the locking block 18 and the locking lever 22. In the bottle holder 60, both the first flexible strap 14 and the second flexible strap 62 are similarly provided with inexpensive locking means comprising the locking blocks 18, 66 and the locking levers 22, 74. In this way, a significant advantage is achieved over bottle and article holders in the prior art, which require the use of comparatively expensive VELCRO® closures or of screws requiring tools for tightening.

While the invention has been described in its preferred forms or embodiments with some degree of particularity, it is understood that this description has been given only by way of example, and that numerous changes can be made in the construction and arrangement of parts without departing from the spirit and scope of the invention, as defined in the appended claims.

What is claimed is:

1. Apparatus for attaching a bottle to a support structure, wherein the apparatus comprises:

a first flexible strap including a locking block at a first end of the first flexible strap, wherein the locking block has a strap receiving surface for removably receiving a second end of the first flexible strap, opposite the first end, with the first flexible strap formed into a loop around the bottle, and a locking lever, mounted within the locking block to move between a disengaged position, in which the locking lever allows the second end of the first flexible strap to freely slide along the strap receiving surface, and an engaged position, in which the locking lever holds the second end of the first flexible strap in place against the strap receiving surfaces; and an attachment structure having a first strap receiving structure for receiving and holding the first flexible strap and support attachment means for engaging the support structure, wherein the support attachment means includes a second flexible strap including a locking block at a first end of the second flexible strap, wherein the locking block has a strap receiving surface for removably receiving a second end of the second flexible strap, opposite the first end, with the second flexible strap formed into a loop around the support structure, and a locking lever, mounted within the locking block to move between a disengaged position, in which the locking lever allows the second end of the second flexible strap to freely slide along the strap receiving surface, and an engaged position, in which the locking lever holds the second end of the second flexible strap against the strap receiving surfaces.

2. The apparatus of claim 1, wherein the strap receiving surface of the second flexible strap includes an outwardly facing clamping surface, the locking lever of the second flexible strap is pivotally mounted outwardly adjacent the clamping surface, and the locking lever of the second flexible strap includes a spiral clamping surface disposed outwardly from the clamping surface at a distance sufficient to permit free sliding movement of second end of the second flexible strap along the outwardly facing clamping surface with the locking lever in the disengaged position and disposed close enough to the clamping surface to hold the second end of the second flexible strap compressed against the clamping surface with the locking lever in the engaged position.

3. The apparatus of claim 2, wherein contact between the spiral clamping surface of the locking lever of the second flexible strap and the second end of the second flexible strap, as the locking lever is moved from the disengaged position into the engaged position with the second flexible strap formed into a loop with the second end of the second flexible strap extending between the spiral clamping surface and the outwardly facing clamping surface, causes the loop to tighten.

4. The apparatus of claim 1, wherein the first strap receiving structure of the attachment structure holds a central portion of the first flexible strap so that the first flexible strap extends laterally, and the support attachment means of the attachment structure includes a second strap receiving structure holding a central portion of the second flexible strap so that the second flexible strap extends vertically.

5. The apparatus of claim 4, wherein the first strap receiving structure includes a pair of slots extending adjacent a concave contact surface formed at a first radius, the second strap receiving structure includes a pair of slots adjacent a concave contact surface formed at a second radius, substantially smaller than the first radius.

6. The apparatus of claim 4, wherein the locking block of the first flexible strap has an inwardly directed concave surface formed at a third radius, and the locking block of the second flexible strap has an inwardly directed concave surface formed at a fourth radius, substantially smaller than the third radius.

* * * * *